United States Patent [19]

Holmgren et al.

[11] Patent Number: 4,780,581

[45] Date of Patent: Oct. 25, 1988

[54] SUICIDE SWITCH/INTERRUPTER WITH VARIABLE VOLUME CHAMBER AND PUFFER ACTION

[75] Inventors: Nils V. Holmgren, Greendale; Donald R. Martin, Waukesha, both of Wis.

[73] Assignee: RTE Corporation, Brookfield, Wis.

[21] Appl. No.: 115,529

[22] Filed: Oct. 30, 1987

[51] Int. Cl.[4] ..... H01H 33/88

[52] U.S. Cl. ..... 200/148 A; 200/148 R; 200/145

[58] Field of Search ..... 200/148 A, 148 R, 145

[56] References Cited

U.S. PATENT DOCUMENTS

| | | | |
|---|---|---|---|
| 3,566,055 | 2/1971 | Weston et al. | 200/48 |
| 3,769,479 | 10/1973 | Leeds | 200/148 A |
| 3,814,883 | 6/1974 | Milianowicz | 200/148 G |
| 3,839,613 | 10/1974 | Tsubaki et al. | 200/148 A |
| 3,932,720 | 1/1976 | Gaigg et al. | 200/148 R |
| 3,970,811 | 7/1976 | Krebs | 200/148 A |
| 4,044,211 | 8/1977 | Cromer et al. | 200/148 A |
| 4,139,751 | 2/1979 | Rostron et al. | 200/148 A |
| 4,139,752 | 2/1979 | Itai et al. | 200/148 R |
| 4,139,753 | 2/1979 | Cromer et al. | 200/148 A |
| 4,160,888 | 7/1979 | Natsui et al. | 200/148 A |
| 4,163,131 | 7/1979 | Perkins | 200/148 A |
| 4,182,942 | 1/1980 | Koyanagi et al. | 200/148 A |
| 4,243,860 | 1/1981 | Kii | 200/148 R |
| 4,253,002 | 2/1981 | Kii | 200/148 R |
| 4,264,794 | 4/1981 | Kii | 200/148 A |
| 4,276,456 | 6/1981 | Cromer et al. | 200/148 A |
| 4,302,645 | 11/1981 | Thaler | 200/148 A |
| 4,465,910 | 8/1984 | Martin | 200/148 R |
| 4,467,158 | 8/1984 | Kobayashi et al. | 200/148 A |
| 4,475,018 | 10/1984 | Arimoto et al. | 200/148 A |
| 4,489,226 | 12/1984 | Holmgren et al. | 208/148 A |
| 4,524,257 | 6/1985 | Slamecka | 200/148 A |
| 4,553,004 | 11/1985 | Thuries | 200/148 A |
| 4,556,767 | 12/1985 | Egli et al. | 200/148 A |
| 4,565,911 | 1/1986 | Slamecka | 200/148 A |
| 4,639,565 | 1/1987 | Pham | 200/148 A |
| 4,650,941 | 3/1987 | Thuries et al. | 200/148 A |
| 4,650,942 | 3/1987 | Perret | 200/148 A |

*Primary Examiner*—Robert S. Macon

*Attorney, Agent, or Firm*—David R. Price; James Earl Lowe, Jr.

[57] ABSTRACT

A switch apparatus comprising a fixed tubular contact having an inner end, a movable tubular contact having an inner end and being movable between a closed position wherein the inner ends of the contacts overlap and an open position wherein the inner ends of the contacts are spaced apart, a piston fixed to the movable contact for movement thereiwth, a cylinder slideably receiving the piston and cooperating with the piston to define a variable volume pressure chamber which decreases in volume as the movable contact moves from the closed position to the open position, and a housing fixed to the piston and having an inner surface which cooperates with the piston to define an arc chamber containing the inner end of the movable contact, the housing having therein an aperture through which the fixed contact extends when the movable contact is in the closed position, and the arc chamber communicating with the pressure chamber so that gas is forced from the pressure chamber into the arc chamber when the movable contact moves from the closed position to the open position.

28 Claims, 3 Drawing Sheets

SUICIDE SWITCH/INTERRUPTER WITH VARIABLE VOLUME CHAMBER AND PUFFER ACTION

BACKGROUND OF THE INVENTION

The invention relates to switch and interrupter mechanisms, and more particularly to such mechanisms utilizing a gas such as sulfur hexafluoride ($SF_6$) to extinguish an arc.

In such mechanisms, arc interruption is caused by the removal of heat, which is caused by gas flow over the arc. High currents require high gas pressure and density and the removal of large amounts of heat. Low currents require relatively low gas pressure and density and the removal of relatively small amounts of heat.

The required increase in gas pressure and density can be achieved in several ways. One way is to impart mechanical energy to a gas volume to compress the gas in a variable volume chamber and thereby provide the increased pressure and density. This is known as "puffer" interruption. A disadvantage of this method is that it requires a relatively large prime mover to provide the required energy needed for high currents. Another way to provide the required increase in pressure and density is to use the arc as a source of energy to raise the enthalpy of the gas. This is known as "suicide" interruption. A disadvantage of this method is that at low currents it provides insufficient energy for interruption. Furthermore, any given interrupter has a fixed volume that is sized to accommodate the maximum fault current anticipated. The interrupter is then relatively inefficient at other currents.

To improve poor low current performance, suicide interrupters have employed auxiliary means, e.g., secondary pistons and magnetic assists, to overcome the lack of gas flow. Such auxiliary means are relatively expensive and complex. Also, puffer interrupters and suicide interrupters have been combined in an effort to reduce the energy required from a prime mover when interrupting high currents. Such combined interrupters typically maximize the amount of gas which flows from the variable volume chamber by minimizing the remaining volume. While this utilizes all of the available gas, it is an inefficient use of suicide action. Also, current puffer interrupters avoid excessive gas temperatures by providing increased gas volume and flow. The increased volume provides additional gas to absorb heat, and the additional flow limits heat input to the gas. To accommodate the additional volume and flow, larger prime movers are required. A typical puffer interrupter causes a pressure rise on the order of 50–70 psi at no load or low current. The pressure rise at no load is solely the result of mechanical energy from the prime mover.

SUMMARY OF THE INVENTION

The invention provides an interrupter/switch that works efficiently over a wide range of current levels. As opposed to puffer interrupters in which suicide energy must be limited because the remaining volume of the variable volume chamber is minimized, the interrupter of the invention insures that a fixed minimum volume of gas remains in the variable volume chamber after the opening stroke. Retention of this minimum volume permits the use of all available suicide energy without the usual undesired side effect of excessive temperatures. Furthermore, the interrupter of the invention causes only a minimal pressure rise at low currents, so that a relatively small prime mover can be used.

More particularly, the invention provides a switch or interrupter apparatus comprising a fixed tubular contact having an inner end, and a movable tubular contact coaxial with the fixed contact and also having an inner end and an outer end. The fixed contact is fixedly connected to a first interface contact that is releasably connected to the electrical circuit to be protected, and the movable contact is slideably housed by a conductive member that is connected to a second interface contact. The second interface contact is releasably connected to the circuit to be protected.

The movable contact is axially movable between a closed position wherein the inner ends of the fixed and movable contacts telescopingly overlap and an open position wherein the inner ends of the contacts are spaced apart. During a normal opening operation, separation of the contacts causes an arc to be drawn between the inner ends of the contacts.

The apparatus also comprises a piston fixed to and movable with the movable contact, the piston being located intermediate the opposite ends of the movable contact and having a first side facing the fixed contact. The apparatus further comprises a cylinder slideably receiving the piston and cooperating with the piston for defining a variable volume pressure chamber which decreases in volume as the movable contact moves from the closed position to the open position. In the preferred embodiment, the conductive member housing the movable contact defines an end wall of the cylinder, which end wall is substantially spaced from the piston when the movable contact is in the open position. In other words, a substantial portion of the original volume of the pressure chamber is not displaced from the pressure chamber as the movable contact moves from the closed position to the open position. This is explained further hereinafter. Also, in the preferred embodiment, the cylinder end wall has therein an annular recess surrounding the movable contact. Since the end wall (the conductive member) is connected to the second interface contact, the recess allows maximization of the volume of the pressure chamber while minimizing the distance between the two interface contacts.

The apparatus further comprises a housing fixed to the first side of the piston and having an inner surface which cooperates with the first side of the piston to define an arc chamber containing the inner end of the movable contact. The arc chamber communicates with the variable volume pressure chamber via passageways through the piston so that gas is forced from the pressure chamber into the arc chamber when the movable contact moves from the closed position to the open position.

More particularly, in the preferred embodiment, the housing includes a generally cylindrical portion surrounding the inner end of the movable contact. The cylindrical portion has a first or lower end fixed to the first side of the piston and an opposite second or upper end. The housing also includes a cap portion that has therein an aperture through which the fixed contact extends when the movable contact is in the closed position and that otherwise closes the upper end of the cylindrical portion. The cap portion is integrally connected to the cylindrical portion and curves inwardly from the upper end of the cylindrical portion through an arc of approximately 90°. Preferably, the cap portion has a substantially constant radius of curvature.

Preferably, when the movable contact is in the closed position, the inner ends of the contacts overlap a certain distance, and the inner end of the fixed contact extends into the arc chamber a distance greater than the distance which the inner ends of the contacts overlap. When the movable contact moves from the closed position to the open position, the inner ends of the contacts separate before the inner end of the fixed contact is withdrawn from the aperture in the housing. When the inner ends of the contacts are overlapping, the housing substantially prevents gas from flowing out of the arc chamber. When the inner ends of the contacts separate, and until the inner end of the fixed contact is withdrawn from the aperture, the housing substantially prevents gas from flowing out of the arc chamber except through the inner ends of the contacts.

The construction of the housing causes gas flowing along the inner surface of the housing to turn radially inwardly toward the axis of the movable and fixed contacts. This promotes extinction of the arc. When the inner end of the fixed contact is near the cap portion of the housing or is within the aperture in the cap portion of the housing, the curvature of the cap portion causes gas flow straight across the arc to extinguish the arc, if the arc is still present.

The pressure chamber has a maximum volume when the movable contact is in the closed position, and movement of the movable contact from the closed position to the open position displaces a certain volume of gas from the pressure chamber. The maximum volume of the pressure chamber is defined as a function of maximum fault current and is preferably 0.30 KA per cubic inch. The pressure chamber has a displaced volume and the ratio of the displaced volume to the maximum volume is preferably 0.70. Also, the arc chamber has a volume and the ratio of the arc chamber volume to the sum of the arc chamber volume and the maximum volume of the pressure chamber is preferably 0.15.

The ratio of the displaced volume to the maximum volume of the pressure chamber affects the amount of suicide action provided by the apparatus. The higher the ratio, i.e., the less the remaining or undisplaced volume, the greater the pressure increase due to arc heat and the larger the amount of mechanical energy required. On the other hand, too low a ratio, i.e., too much undisplaced or remaining volume, causes too much arc energy to be absorbed, with the result being little suicide action and insufficient pressure rise. It has been found that a ratio of between 0.60 and 0.80 provides an optimal balance between mechanical energy and suicide action. This balance is optimal because a fixed amount of energy is required to accelerate and separate the contacts during a specific time period, and it is not necessary to increase the energy to operate the apparatus due to the pressure increase of the gas during arcing.

The ratio of arc chamber volume to the sum of the arc chamber volume and the maximum pressure chamber volume affects the amount of arc energy absorbed by the gas in the pressure chamber. It has been found that a ratio of between 0.10 and 0.20 is optimal. Also, the absolute combined volume of the arc chamber and the pressure chamber, the volume of the pressure chamber being a function of maximum fault current, is necessary to prevent excessive heating and erosion of the housing material. It has been found that a ratio of the maximum fault current to the pressure chamber volume of between 0.25 and 0.40 KA per cubic inch is optimal.

An advantage of the above-described mechanism is that it can be used either as a switch or as an interrupter, depending on the operating mechanism (prime mover) used.

Other features and advantages of the invention will become apparent to those skilled in the art upon review of the following detailed description, claims and drawings.

Figures 1, 5:
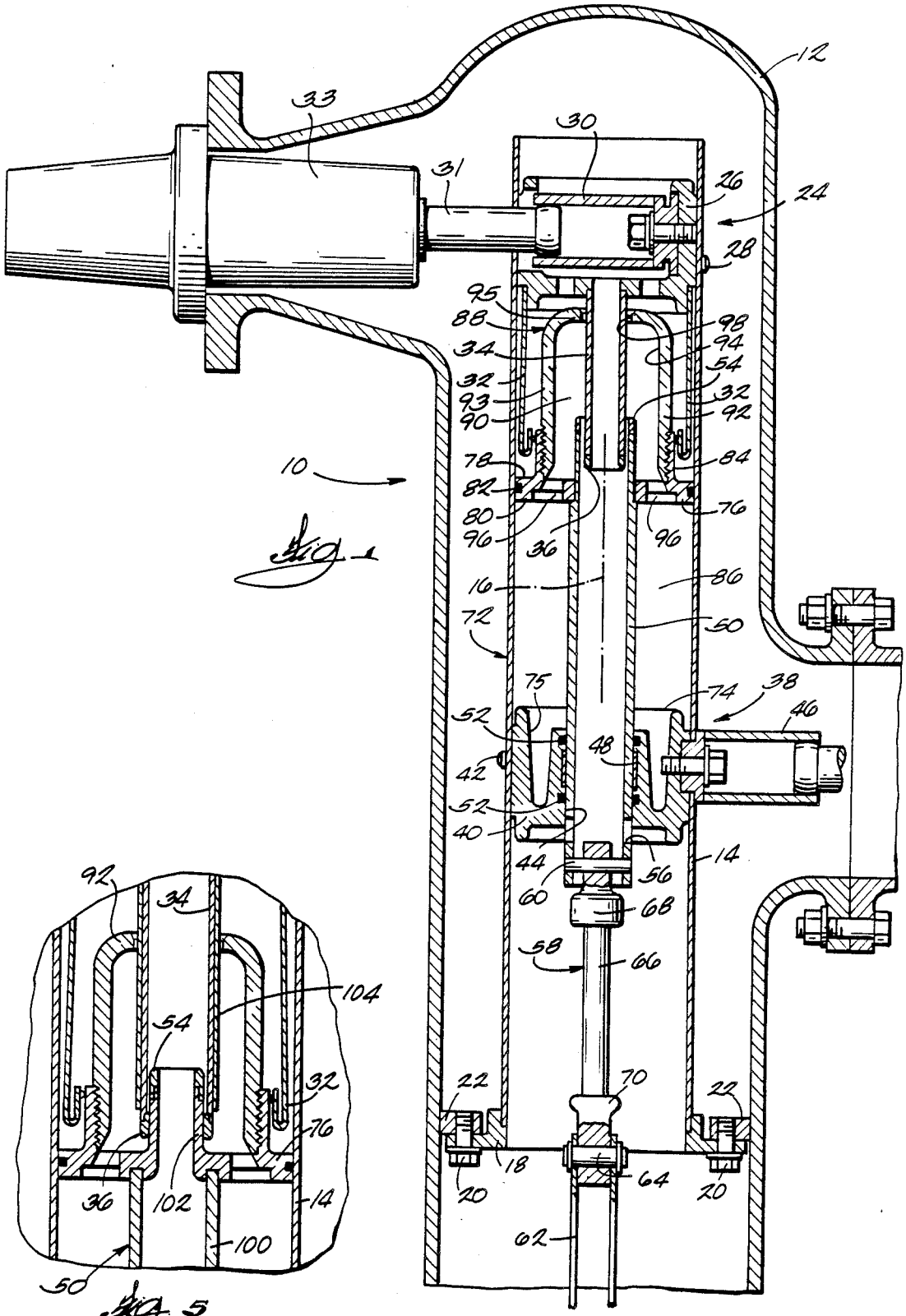
FIG. 1 is an elevational view, partially in cross section, of an interrupter/switch mechanism embodying the invention and including a movable contact. The movable contact is movable between a closed position and an open position and is shown in the closed position.
FIG. 5 is an enlarged, partial view showing an alternative embodiment of the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A switch/interrupter apparatus 10 embodying the invention is illustrated in the drawings. The apparatus 10 comprises a pressure vessel or enclosure 12 which contains a suitable dielectric fluid, such as sulfur hexafluoride ($SF_6$) gas. The apparatus 10 also comprises a dielectric tube 14 having a longitudinal axis 16. The tube 14 is supported within the pressure vessel 12 by a mounting ring 18 which is in turn secured by suitable means such as bolts 20 to inwardly extending mounting lugs 22 inside the pressure vessel 12. The tube 14 is sized to provide structural and dieletric strength. The length and diameter of the tube 14 are sized to meet the interrupting and voltage requirements of the switch.

The apparatus 10 also comprises an upper conductive assembly 24 including an upper conductive member 26 fixedly mounted within the tube 14 by suitable means such as fasteners 28. The assembly 24 also includes an interface contact 30 mounted on the upper conductive member 26, a plurality of finger-like load current contacts 32 extending downwardly from and fixedly connected to the upper conductive member 26, and a tubular fixed contact 34 extending downwardly from the upper conductive member 26 along the longitudinal axis 16 of the tube 14. The interface contact 30 is releasably connected to a conductor 31 which is mounted in a bushing 33 and which is connected to the electrical circuit (not shown) to be protected.

The upper end of the fixed contact 34 opens into the interior of the upper conductive member 26 adjacent the interface contact 30. From the upper end of the fixed contact 34, gas can pass around the interface contact 30 and flow into the interior of the pressure vessel 12. The lower or inner end of the fixed contact 34 has thereon an arcing tip 36 made of an arc-resistant material such as copper tungsten.

The apparatus 10 also comprises a lower conductive assebly 38 including a lower conductive member 40 fixedly mounted within the tube 14 by suitable means such as fasteners 42. The lower conductive member 40 is annular and has therethrough a generally cylindrical passageway 44 centered on the longitudinal axis 16 of the tube 14. The assembly 38 also includes a lower interface contact 46 mounted on the lower conductive member 40 and extending exteriorly of the tube 14, and an annular current interchange contact 48 mounted within the passageway 44 and centered on the axis 16. The lower interface contact 46, like the upper interface contact 30, is releasably connected to the electrical circuit (not shown) to be protected.

The apparatus 10 also comprises a tubular movable contact 50 slideably received within the lower conductive member passageway 44 and within the current interchange contact 48 so that the movable contact 50 extends along the longitudinal axis 16 and is in electrical contact with the current interchange contact 48. A pair of suitable bearing and sealing rings 52 center the movable contact 50 within the passageway 44, prevent electrical contact between the movable contact 50 and the lower conductive member 40 and limit gas flow through the passageway 44 between the movable contact 50 and the lower conductive member 40.

The contact 50 has an upper or inner end, and a lower or outer end. The upper end of the contact 50 has thereon an arcing tip 54 similar to the tip 36. The lower end of the movable contact extends beneath the lower conductive member 40 and is open to the interior of the tube 14. The movable contact 50 also has therein a plurality of ports 56 located adjacent the lower end and beneath the lower conductive member 40. The ports 56 are open to the interior of the tube 14. Also, the movable contact 50 has an inside diameter that is slightly greater than the outside diameter of the fixed contact 34.

The movable contact 50 is movable between a closed or uppermost position (shown in FIG. 1) wherein the inner or upper end of the movable contact 50 telescopingly overlaps the inner or lower end of the fixed contact 34 and wherein the inner ends of the contacts 34 and 50 are separated by a small radial gap, and an open or lowermost position (shown in FIG. 4) wherein the inner end of the movable contact 50 is spaced from the inner end of the fixed contact 34. When the movable contact 50 is in the closed position, the radial spacing between the inner ends of the contacts 34 and 50 prevents direct current flow between the inner ends but is slight enough to substantially prevent gas flow between the inner ends.

The apparatus 10 also comprises means for moving the movable contact 50 between the closed position and the open position. While various suitable moving means can be employed, in the preferred embodiment, such means includes an operating rod 58 including an insulating center section 66 and conductive end fittings 68 and 70 respectively supporting pins 60 and 64. The pin 60 is pivotally connected to the lower end of the movable contact 50. A prime mover 61 (shown schematically) includes an actuating member 62 connected to the pin 64 and thereby moves the operating rod 58. It should be noted that the member 62 of the present application corresponds to the member 29 of the above-incorporated application. As explained below. other suitable prime movers, including switch operating mechanisms, can be employed.

The apparatus 10 also comprises means for limiting movement of the movable contact 50 beyond the open position in the direction away from the closed position, and means for limiting movement the movable contact 50 beyond the closed position in the direction away from the open position. While various suitable limiting means can be employed, in the preferred embodiment, the limiting means includes the operating rod 58. Upward movement of the operating rod 58 is limited to the position in which the movable contact 50 is in the closed position, and downward movement of the operating rod 58 is limited to the position in which the movable contact 50 is in the open position Ahy suitable means can be used for limiting movement of the operating rod 58. In the preferred embodiment, the prime mover 61 limits movement of the operating rod 58.

The apparatus 10 also comprises piston and cylinder means. While various suitable piston and cylinder means can be used, in the preferred embodiment, the piston and cylinder means includes a oylinder 72 which includes the tube 14 and the lower conductive member 40. The first or upper surface of the lower conductive member 40 defines an end wall 74 of the cylinder 72. In the preferred embodiment, the end wall 74 has therein an annular recess 75 surrounding the movable contact 50. Since the end wall 74, i.e., the conductive member 40, is fixedly connected to the lower interface contact 46, the below-described pressure chamber 86 while minimizing the distance between the upper interface contact 30 and the lower interface contact 46. This allows minimization of the overall size of the apparatus 10.

The piston and cylinder means also includes a piston 76 which is fixedly connected to and movable with the movable contact 50. The piston 76 is located intermediate the ends of the movable contact 50 and has a first or upper side 78 facing the fixed contact 34, and an opposite second or lower side 80. Preferably, the piston 76 is conductive, and a bearing and sealing ring 82 prevents contact between the piston 76 and the inner surface of the tube 14 so that conductive particles are not abraded from the piston 76 and deposited on the dielectric tube 14. The ring 82 also prevents gas flow between the piston 76 and the inner wall of the tube 14. As shown in the drawings, the piston 76 includes an upwardly extending, annular portion 84 which engages the load current contacts 32 when the movable contact 50 is in the closed position.

Figure 4:
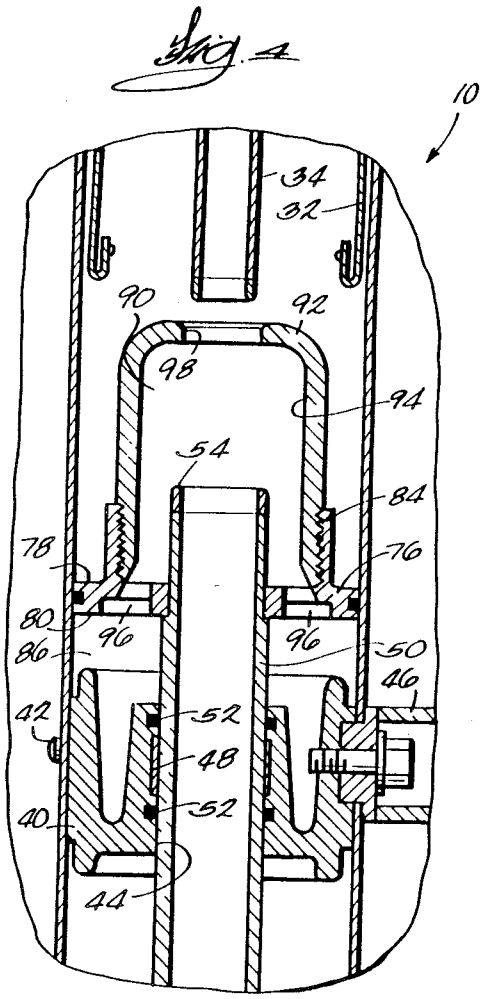
FIG. 4 is a view similar to FIG. 2 and showing the movable contact in the open position.
Figure 3:
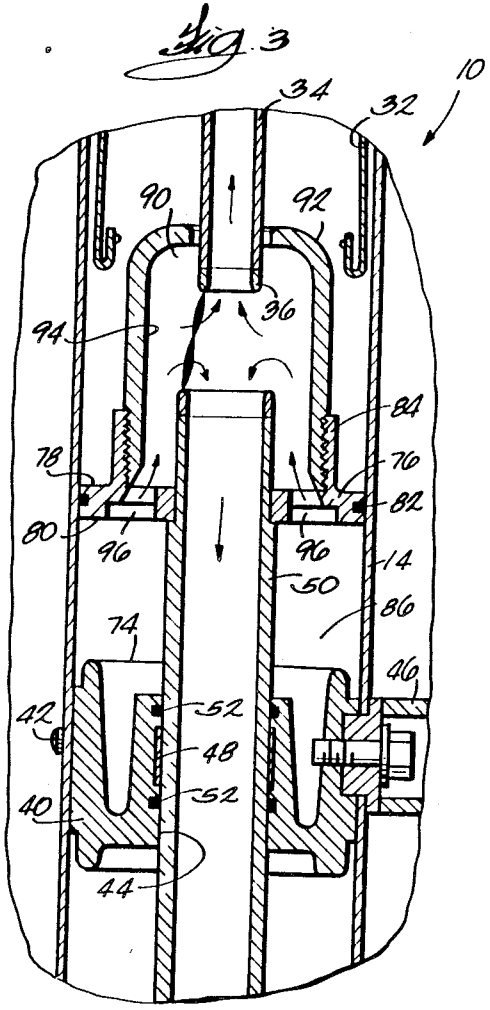
FIG. 3 is a view similar to FIG. 2 showing the movable contact intermediate the open position and the position shown in FIG. 2.

The piston 76 and cylinder 72 define a variable volume pressure chamber 86. The pressure chamber 86 has a maximum volume, which is a function of maximum fault current (perferably 0.30 KA per cubic inch), when the movable contact 50 is in the closed position, and movement of the movable contact 50 from the closed position to the open position causes the piston 76 to reduce the volume of the pressure chamber 86 and displace a certain volume of gas from the pressure chamber 86. In the preferred embodiment, the ratio of the displaced volume to the maximum volume is between 0.60 and 0.80, and is preferably 0.70. The result is that 30% of the gas in the pressure chamber 86 is retained therein. The benefit of this is explained below. Accordingly, when the movable contact 50 is in the open position, as shown in FIG. 4, the portion 76 is substantially spaced from the end wall 74 of the cylinder 72.

The apparatus 10 further comprises wall means 88 defining an arc chamber 90 communicating with the pressure chamber 86 so that gas flows from the pressure chamber 86 into the arc chamber 90 when the movable contact 50 moves from the closed position to the open position. i.e., when the volume of the pressure chamber 86 is reduced. While various suitable wall means can be employed, in the preferred embodiment, the wall means 88 includes an insulating housing 92 fixed to the upper side 78 of the piston 76 and having an inner surface 94 which cooperates with the upper side 78 of the piston 76 to define the arc chamber 90. In the illustrated construction, the piston 76 has therethrough a plurality of passageways 96 through which the arc chamber 90 communicates with the pressure chamber 86.

In the preferred embodiment, the housing 92 includes a generally cylindrical portion 93 surrounding the inner end of the movable contact 50. The cylindrical portion 93 has a first or lower end fixed to the upper side of the piston 76 and an opposite second or upper end. In the illustrated construction, the lower end of the cylindrical portion 93 threadedly engages the inner surface of the annular piston pistion 84. The housihg 92 also includes a cap portion 95 which except for the below-described aperture 98 substantially closes the upper end of the cylindrical portion 93. The cap portion 95 is integrally connected to the cylindrical portion 93 and curves inwardly, through an arc of approximately 90°, from the upper end of the cylindrical portion 93. In the preferred embodiment, the cap portion 95 has a substantially constant radius of curvature.

As mentioned above, the cap portion 95 of the housing 92 has therein an aperture 98. The aperture 98 is centered on the longitudinal axis 16, and the fixed contact 32 extends through the aperture 98 when the movable contact 50 is in the closed position. The inner diameter of the aperture 98 is only slightly greater than the outer diameter of the fixed contact 34 so that gas flow through the aperture 98 and between the housing 92 and the fixed contact 34 is substantially prevented when the fixed contact 34 extends through the aperture 98.

As shown in FIG. 1, the fixed contact 34 extends into the housing 92 a certain distance when the movable contact 50 is in the closed position, and this distance is preferably less than the distance between the closed position and the open position, i.e., the length of the opening stroke. Therefore, the fixed contact 34 is completely withdrawn, from the housing 92 before the movable contact 50 reaches the open position. Preferably, when the movable contact 50 is in the open position, the gap between the inner end of the fixed contact 34 and the housing 92 is approximately equal to ½ the diameter of the fixed contact 34.

As a result of the construction of the housing 92, the upper portion of the movable contact 50 and the cylindrical portion 93 of the housing 92 define a generally annular passageway 97 which communicates with the pressure chamber 86 via the passageways 96 and which directs gas flowing from the pressure chamber 86 upwardly or axially of the contacts 34 and 50 and along the inner surface 94 of the housing 92. The curved cap portion 95 causes gas flowing upwardly along the inner surface 94 of the housing 92 to turn radially inwardly toward the axis 16 of the contacts 34 and 50. This promotes extinction of the arc. Furthermore, when the inner end of the fixed contact 34 is near the cap portion 95 or within the aperture 98, the curvature of the housing 92 causes gas flow straight across the arc to extinguish the arc, if the arc is still present.

The housing 92 is insulating and is preferably made of a material much as polytetrafluoroethylene, so that the housing 92 will not deteriorate or form conductive tracks when exposed to high temperatures. The housing 92 is configured through its internal volume and proximity to adjacent contacts to optimize interrupting performance while minimizing the energy required from the prime mover 62.

In the preferred embodiment, the ratio of the volume of the arc chamber 90 to the sum of the volume of the arc chamber 90 and the maximum volume of the pressure chamber 86 is between 0.10 and 0.20. More particularly, the ratio of the volume of the arc chamber to the sum of the volume of the arc chamber 90 and the maximum volume of the pressure chamber 86 is 0.15.

The apparatus 10 operates as follows. When the movable contact 50 is in the closed position, current flows from the upper interface contact 30 to the lower interface contact 46 via the upper conductive member 26, the load current contacts 32, the piston 76, the movable contact 50, the current interchange 48, and the lower conductive member 40. Because the inner ends of the contacts 34 and 50 are slightly spaced apart, current does not flow through the fixed contact 34 to the movable contact 50.

Figure 2:
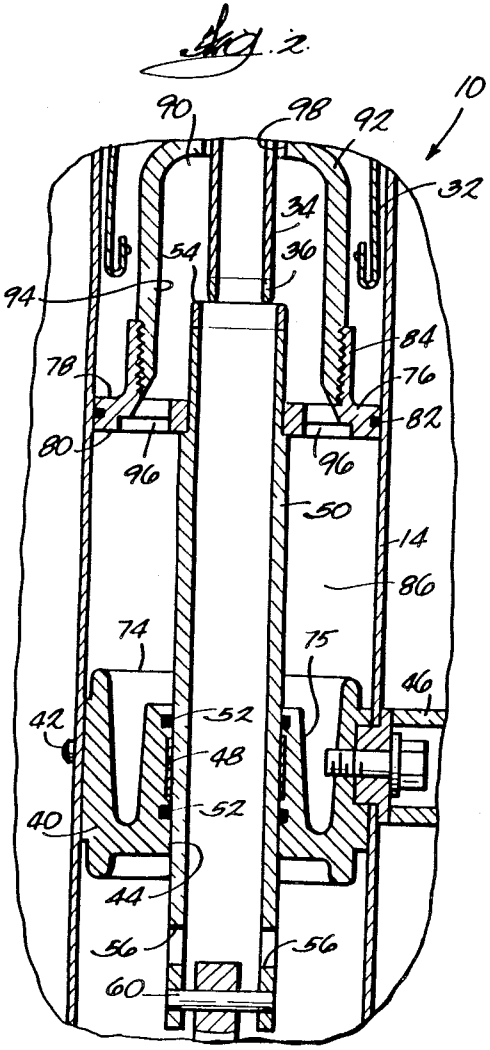
FIG. 2 is a partial, enlarged view similar to FIG. 1 and showing the movable contact in a position intermediate the closed position and the open position.

During the initial portion of the opening, stroke, the load curent contacts 32 maintain electrical contact with the piston 76. Before separation of the inner ends of the contacts 34 and 50, the load current contacts 32 and the piston 76 separate. After the load current contacts 32 and the piston 76 separate, an arc forms between tne load current contacts 32 and the piston 76 and between the inner ends of the contacts 34 and 50. Continued movement of the movable contact 50 toward the open position causes the gap between the load current contacts 32 and the piston 76 to increase, while the annular gap between the inner ends of the contacts 34 and 50 remains constant. Therefore, current transfers completely to the arc between the inner ends of the contacts 34 and 50. When the movable contact 50 reaches the position shown in FIG. 2, the inner ends of the contacts 34 and 50 separate, causing an arc to be drawn between the arcing tips 36 and 54

The wall means 88 encloses the inner ends of the contacts 34 and 50 within the arc chamber 90 during movement of the movable contact 50 from the closed position toward the open position and until the arc between the contacts 34 and 50 is extinguished, and the wall means 88 also substantially prevents gas flow out of the arc chamber 90 except through the inner ends of the contacts 34 and 50 during movement of the movable contact 50 from the cIosed position toward the open position and until the arc between the contacts 34 and 50 is extinguished. In other words, until the inner ends of the contacts 34 and 50 separate, thereby permitting gas to flow out of the arc chamber 90 through the contacts 34 and 50, gas is substantially prevented from flowing out of the arc chamber 90. As a result, during the portion of the opening stroke prior to separation of the inner ends of the contacts 34 and 50, the gas in the combined volume of the arc chamber 90 and pressure chamber 86 is compressed. This is a precompression period that prepares the apparatus 10 thermodynamically for the upcoming interruption process.

During the portion of the opening stroke after separation of the inner ends of the contacts 34 and 50 and before the fixed contact 34 is completely withdrawn from the housing 92, gas flows out of the arc chamber 90 substantially on1y through the contacts 34 and 50. Therefore, the pressure increase of the gas due to reduction of the volume of the pressure chamber 86 and due to the heat of the arc is utilized almost entirely to cause gas flow over the arc. A portion of the heat from the arc is removed by the gas flow. The remaining heat from the arc raises the temperature and pressure of the gas within the arc chamber 90 and the pressure chamber 86, thereby further causing gas flow and arc cooling. The gas cools as it flows through the contacts 34 and 50 and impinges on the interface contacts 34 and 46. Cooling of the gas flowing out of the lower end of the contact 50 prevents the gas from bridging the internal dielectric structure of the tube 14. Cooling of the arc deionizes the arc and eventually causes interruption at current zero. All interruption takes place before the contact 34 is withdrawn from the aperture 98.

Finally, the fixed contact 34 is completely witndrawn from the housing 92 and the movable contact 50 reaches the open position (shown in FIG. 4).

In the preferred embodiment, the construction of the apparatus 10 is such that movement of the movable contact 50 from the closed position to the open position increases tne pressure of gas within the arc chamber 90 and the pressure chamber 86 less than 10 psi in the absence of an arc between the contacts 34 and 50. This is substantially less than the pressure rise (between 50 and 70 psi) in the absence of an arc in prior art apparatus. The result is that substantially less energy is required to move the movable contact 50 from the closed position to the open position. If an arc is present, the interruption process benefits from suicide action, i.e., heating of the gas by the arc, in which case significantly higher pressures (a pressure rise of about 100 psi) are attained. The actual pressure that is developed is a function of the current and with proper thermodynamic design can be tailored to match the requirements of the current that is being interrupted. The apparatus 10 is thermodynamically designed to utilize a portion of the arc heat to raise the enthalpy or energy of the gas that is being compressed. Retention of a substantial portion (preferably 30%) of the gas in the pressure chamber 86 permits the use of all available suicide energy without the usual undesired side effect of excessive temperatures.

During the closing stroke, gas flows through the the contacts 34 and 50 and the arc chamber 90 to fill the expanding pressure chamber 86. Gas flow between the inner ends of the contacts 34 and 50 prevents undesirable prestrike until the inner ends of the contacts 34 and 50 are relatively close. Eventually, the load current contacts 32 contact the piston 76, so that full load current flows through the load current contacts 32 and the piston 76, as described above.

An alternative embodiment of the invention is illustrated in FIG. 5. Except as explained below, the alternative embodiment is identical to the preferred embodiment and common elements have been given the same reference numerals.

In the alternative embodiment, the inner ends of the contacts 34 and 50 are in electrical contact with each other when the movable contact 50 is in the closed position. More particularly, the movable contact 50 includes a tube 100 substantially identical to the movable contact 50 of the preferred embodiment except that the upper end of the tube 100 terminates at the piston 76. The piston 76 has thereon an integral, upwardly extending annular portion 102 which forms the inner end of the movable contact 50. As shown in FIG. 5, the annular portion 102 extends inside the lower end of the fixed contact 34 when the movable contact 50 is in the closed position.

The lower end of the fixed contact 34 is bifurcated in order to provide an interference fit between the inner ends of the contacts 34 and 50. As a result of the bifurcation the fixed contact 34 is divided into a plurality of finger-like portions. In order to bias the finger-like portions of the fixed contact 34 against the inner end of the movable contact 50 and also to prevent gas flow outwardly through the spaces between the finger-like portions of the fixed contact 34, a sleeve member 104 surrounds the fixed contact 34.

This alternative construction of the contacts 34 and 50 can be used either with or without the load current contacts 32 of the preferred embodiment. If the load current contacts 32 are not used, the current capacity of the apparatus 10 is smaller due to the smaller physical size of the current conducting elements. In this case, current is simply carried by the contacts 34 and 50 until the inner ends of the contacts 34 and 50 separate, after which an arc forms between the arcing tips 36 and 54. If the alternative construction is used in combination with the load current contacts 32, as shown in FIG. 5, current is carried by both the contacts 34 and 50 and the load current contacts 32 when the movable contact 50 is in the closed position. When the load current contacts 32 are separated from the piston 76, current is transferred to the contacts 34 and 50. When the inner ends of the contacts 34 and 50 separate, an arc forms between the arcing tips 36 and 54.

Figure 6:
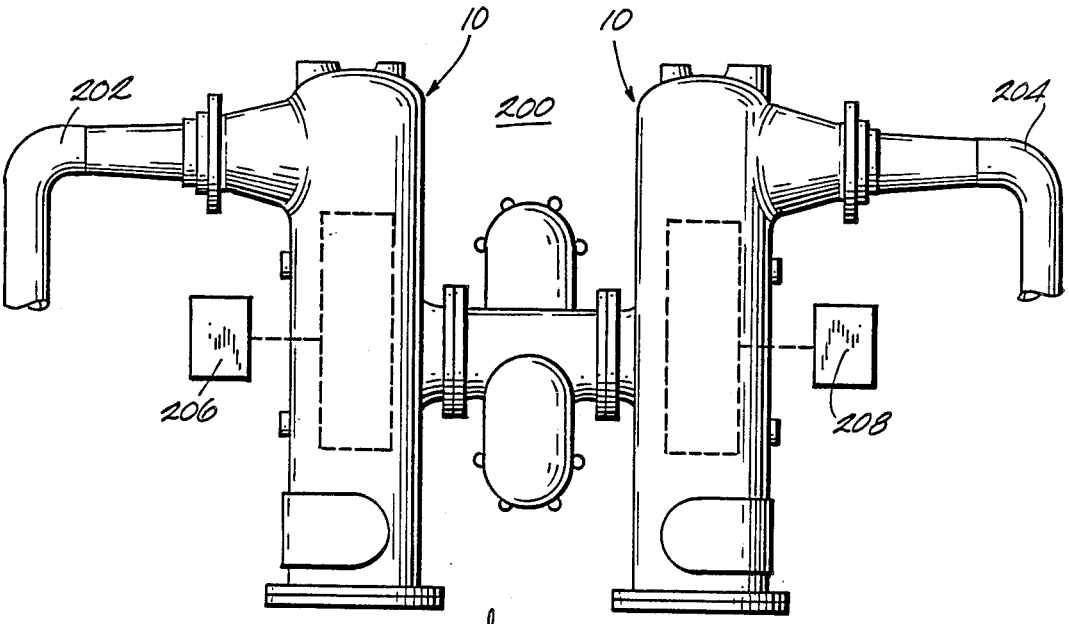
FIG. 6 is a partially schematic elevational view of switchgear apparatus including two interrupter/switch mechanisms.

A switchgear apparatus 200 including a pair of switch/interrupter apparatus 10 is illustrated in FIG. 6. The conductor 31 of the left apparatus 10 is connected to a power line 202, and the conductor 31 of the right apparatus 10 is connected to power line 204. The lower interface contacts 46 of the two apparatus 10 are connected to each other by suitable means (not shown). The apparatus 10 are identical.

The prime mover 206 (shown schematically) for the left apparatus 10 is an interrupter operating mechanism as described above. Accordingly, the 1eft apparatus 10 functions as a interrupter.

The prime mover 208 (shown schematically) for the right apparatus 10 is a switch operating mechanism. Accordingly, the right apparatus 10 functions as a switch.

Various features of the invention are set forth in the following claims.

We claim:

1. A switch apparatus comprising a fixed tubular contact extending along an axis and having an inner end, a movable tubular contact extending along said axis and having an inner end, said movable contact being movable along said axis between a closed position wherein said inner ends of said contacts telescopingly overlap and an open position wherein said inner ends of said contacts are spaced apart, movement of said movable contact from said closed position to said open position causing an arc to form between said inner ends of said contacts, means for limiting movement of said movable contact beyond said open position in the direction away from said closed position, a piston and a cylinder defining a variable volume pressure chamber, said cylinder including an end wall facing said piston, one of said piston and said cylinder being fixed relative to said fixed contact, and the other of said piston and said cylinder being movable with said movable contact to reduce the volume of said pressure chamber when said movable contact moves from said closed position to said open position, said piston being substantially spaced from said end wall when said movable contact is in said open position, and wall means for defining an arc chamber communicating with said pressure chamber, for enclosing said inner ends of said contacts within said arc chamber during movement of said movable contact from said closed position toward said open position and until the arc between said contacts is extinguished, and for substantially preventing gas flow out of said arc chamber except through said inner ends of said contacts during movement of said movable contact from said closed position toward said open position and until the arc between said contacts is extinguished.

2. An apparatus as set forth in claim 1 wherein said wall means is fixed to and movable with said movable contact, and wherein said fixed contact extends into said wall means when said movable contact is in said closed position and is withdrawn from said wall means as said movable contact moves toward said open position.

3. An apparatus as set forth in claim 2 wherein said fixed contact extends into said wall means a certain distance when said movable contact is in said closed position, and wherein said certain distance is less than the distance between said closed position and said open position.

4. A switch apparatus comprising a fixed tubular contact extending along an axis and having an inner end, a first interface contact fixedly and electrically connected to said fixed contact, a movable tubular contact extending along said axis and having an inner end, said movable contact being movable along said axis between a closed position wherein said inner ends of said contacts telescopingly overlap and an open position wherein said inner ends of said contacts are spaced apart, movement of said movable contact from said closed position to said open position causing an arc to form between said inner ends of said contacts, means for limiting movement of said movable contact beyond said open position in the direction away from said closed position, a piston and a cylinder defining a variable volume pressure chamber, said cylinder being fixed relative to said fixed contact and including an end wall, said end wall facing said piston, partially defining said pressure chamber and having therein a recess, said piston being movable with said movable contact to reduce the volume of said pressure chamber when said movable contact moves from said closed position to said open position, and a second interface contact fixedly and electrically connected to said cylinder end wall, and wall means for defining an arc chamber communicating with said pressure chamber, for enclosing said inner ends of said contacts within said arc chamber during movement of said movable contact from said closed position toward said open position and until the arc between said contacts is extinguished, and for substantially preventing gas flow out of said arc chamber except through said inner ends of said contacts during movement of said movable contact from said closed position toward said open position and until the arc between said contacts is extinguished.

5. An apparatus as set forth in claim 4 wherein said movable contact is slideably supported by said end wall, and wherein said recess is annular and surrounds said movable contact.

6. An apparatus as set forth in claim 4 wherein said piston is substantially spaced from said end wall when said movable contact is in said open position.

7. A switch apparatus comprising a fixed tubular contact extending along an axis and having an inner end.

a movable tubular contact extending along said axis and having an inner end and an outer end, said movable contact being movable along said axis between a closed position wherein said inner ends of said contacts telescopingly overlap and an open position wherein said inner ends of said contacts are spaced apart, means for limiting movement of said movable contact beyond said open position in the direction away from said closed position, a piston fixed to said movable contact for movement therewith, said piston being located intermediate said ends of said movable contact and having a first side facing said fixed contact, and an opposite second side, cylinder means slideably receiving said piston and cooperating with said second side of said piston to define a variable volume pressure chamber which decreases in volume as said movable contact moves from said closed position to said open position, and a housing fixed to said first side of said piston and having an inner surface which cooperates with said first side of said piston to define an arc chamber containing said inner end of said movable contact, said arc chamber communicating with said pressure chamber so that gas is forced from said pressure chamber into said arc chamber when said movable contact moves from said closed position to said open position, said housing including a generally cylindrical portion, said cylindrical portion surrounding said inner end of said movable contact and having a first end fixed to said first side of said piston and an opposite second end, and said housing also including a cap portion integrally connected to and substantially closing said second end of said cylindrical portion, said cap portion having therein an aperture through which said fixed contact extends into said arc chamber when said movable contact is in said closed position, and said cap portion curving inwardly from said cylindrical portion through an arc of approximately 90° and having a substantially constant radius of curvature.

8. A switch apparatus comprising a fixed tubular contact extending along an axis and having an inner end, a movable tubular contact extending along said axis and having an inner end, said movable contact being movable along said axis between a closed position wherein said inner ends of said contacts telescopingly overlap and an open position wherein said inner ends of said contacts are spaced apart, movement of said movable contact from said closed position to said open position causing an arc to form between said inner ends of said contacts, means for limiting movement of said movable contact beyond said open position in the direction away from said closed position, a piston and a cylinder defining a variable volume pressure chamber, one of said piston and said cylinder being fixed relative to said fixed contact and the other of said piston and said cylinder being movable with said movable contact to reduce the volume of said pressure chamber when said movable contact moves from said closed position to said open position, said pressure chamber having a maximum volume when said movable contact is in said closed position, and wall means for defining an arc chamber having a volume and communicating with said pressure chamber, for enclosing said inner ends of said contacts within said arc chamber during movement of said movable contact from said closed position toward said open position and until the arc between said contacts is extinguished, and for substantially preventing gas flow out of said arc chamber except through said inner ends of said contacts during movement of said movable contact from said closed position toward said open position and until the arc between said contacts is extinguished, the ratio of said arc chamber volume to the sum of said arc chamber volume and said maximum volume being between 0.10 and 0.20.

9. An apparatus as set forth in claim 8 wherein said wall means is fixed to and movable with said movable contact, and wherein said fixed contact extends into said wall means when said movable contact is in said closed position and is withdrawn from said wall means as said movable contact moves toward said open position.

10. An apparatus as set torth in claim 9 wherein said fixed contact extends into said wall means a certain distance when said movable contact is in said closed position, and wherein said certain distance is less than the distance between said closed position and said open position.

11. An apparatus as set torth in claim 8 wherein movement of said movable contact from said closed position to said open position displaces a certain volume of gas from said pressure chamber, and wherein the ratio of said displaced volume to said maximum volume is between 0.60 and 0.80.

12. An apparatus as set forth in claim 11 wherein said cylinder includes an end wall facing said piston, and wherein said piston is substantially spaced from said end wall when said movable contact is in said open position.

13. An apparatus as set forth in claim 8 wherein the movement of said movable contact from said closed position to said open position increases the pressure of gas within said arc chamber and said pressure chamber less than 10 percent in the absence of an arc between said fixed contact and said movable contact.

14. An apparatus as set forth in claim 13 wherein said cylinder includes an end wall facing said piston, and wherein said piston is substantially spaced from said end wall when said moveble contact is in said open position.

15. An apparatus as set rorth in claim 8 wherein said cylinder includes an end wall facing said piston, and wherein said piston is substantially spaced from said end wall when said movable contact is in said open position.

16. A switch apparatus comprising a fixed tubular contact extending along an axis and having an inner end, a movable tubular contact extending along said axis and having an inner end, said movable contact being movable along said axis between a closed position wherein said inner ends of said contacts telescopingly overlap and an open position wherein said inner ends of said contacts are spaced apart, movement of said movable contact from said closed position to said open position causing an arc to form between said inner ends of said contacts, means for limiting movement of said movable contact beyond said open position in the direction away from said closed position, a piston and a cylinder defining a variable volume pressure chamber, one of said piston and said cylinder being fixed relative to said fixed contact and the other of said piston and said cylinder being movable with said movable contact to reduce the volume of said pressure chamber when said movable contact moves from said closed position to said open position, whereby said pressure chamber has a maximum volume when said movable contant is in said closed position, and whereby movement of said movable contact from said closed position to said open position displaces a certain volume of gas from said pressure chamber, the ratio of said displaced volume to said maximum volume being between 0.60 and 0.80, and wall means for defining an arc chamber communicating with said pressure chambe, for enclosing said inner ends of said contacts within said arc chamber during movement of said movable contact from said closed position toward said open position and until the arc between said contacts is extinguished, and for substantially preventing gas flow out of said arc chamber except through said inner ends of said contacts during movement of said movable contact from said closed position toward said open position and until the arc between said contacts is extinguished.

17. An apparatus as set forth in claim 16 wherein said wall means is fixed to and movable with said movable contact, and wherein said fixed contact extends into said wall means when said movable contact is in said closed position and is withdrawn from said wall means as said movable contact moves toward said open position.

18. An apparatus as set forth in claim 17 wherein said fixed contact extends into said wall means a certain distance when said movable contact is in said closed position, and wherein said certain distance is less than the distance between said closed position and said open position.

19. An apparatus as set forth in claim 16 wherein the movement of said movable contact from said closed position to said open position increases the pressure of gas within said arc chamber and said pressure chamber less than 10 percent in the absence of an arc between said fixed contact and said movable contact.

20. An apparatus as set forth in claim 19 wherein said cylinder includes an end wall facing said piston, and wherein said piston is substantially spaced from said end wall when said movable contact is in said open position.

21. An apparatus as set forth in claim 16 wherein said cylinder includes an end wall facing said piston, and wherein said piston is substantially spaced from said end wall when said movable contact is in said open position.

22. A switch apparatus comprising a fixed tubular contact extending along an axis and having an inner end, a movable tubular contact extending along said axis and having an inner end, said movable contact being movable along said axis between a closed position wherein said inner ends of said contacts telescopingly overlap and an open position wherein said inner ends of said contacts are spaced apart, movement of said movable contact from said closed position to said open position causing an arc to form between said inner ends of said contacts, means for limiting movement of said movable contact beyond said open position in the direction away from said closed position, a piston and a cylinder defining a variable volume pressure chamber, one of said piston and said cylinder being fixed relative to said fixed contact and the other of said piston and said cylinder being movable with said movable contact to reduce the volume of said pressure chamber when said movable contact moves from said closed position to said open position, and wall means for defining an arc chamber communicating with said pressure chamber, for enclosing said inner ends of said contacts within said arc chamber during movement of said movable contact from said closed position toward said open position and until the arc between said contacts is extinguished, and for substantially preventing gas flow out of said arc chamber except through said inner ends of said contacts during movement of said movable contact from said closed position toward said open position and until the arc between said contacts is extinguished, the movement of said movable contact from said closed position to said open position increasing the pressure of gas within said arc chamber and said pressure chamber less than 10 psi in the absence of an arc between said fixed contact and said movable contact.

23. An apparatus as set forth in claim 22 wherein said wall means is fixed to and movable with said movable contact, and wherein said fixed contact extends into said wall means when said movable contact is in said closed position and is withdrawn from said wall means as said movable contact moves toward said open position.

24. An apparatus as set forth in claim 23 wherein said fixed contact extends into said wall means a certain distance when said movable contact is in said closed position, and wherein said certain distance is less than the distance between said closed position and said open position.

25. An apparatus as set forth in claim 22 wherein said cylinder includes an end wall facing said piston, and wherein said piston is substantially spaced from said end wall when said moveble contact is in said open position.

26. A switch apparatus comprising a fixed tubular contact extending along an axis and having an inner end, a movable tubular contact extending along said axis and having an inner end and an outer end, said movable contact being movable along said axis between a closed position wherein said inner ends of said contacts telescopingly overlap and an open position wherein said inner ends of said contacts are spaced apart, means for limiting movement of said movable contact beyond said open position in the direction away from said closed position, a piston fixed to said movable contact for movement therewith, said piston being located intermediate said ends of said movable contact and having a first side facing said fixed contact, and an opposite second side, cylinder means slideably receiving said piston and cooperating with said second side of said piston to define a variable volume pressure chamber which decreases in volume as said movable contact moves from said closed position to said open position, said pressure chamber having a maximum volume when said movable contact is in said closed position, and movement of said movable contact from said closed position to said open position displacing a certain volume of gas from said pressure chamber, the ratio of said displaced volume to said maximum volume being between 0.60 and 0.80, and a housing fixed to said first side of said piston and having an inner surface which cooperates with said first side of said piston to define an arc chamber having a volume and containing said inner end of said movable contact, the ratio of said arc chamber volume to the sum of said arc chamber volume and said maximum volume being between 0.10 and 0.20, said housing having therein an aperture through which said fixed contact extends into said arc chamber when said movable contact is in said closed position, and said arc chamber communicating with said pressure chamber so that gas is forced from said pressure chamber into said arc chamber when said movable contact moves from said closed position to said open position.

27. An apparatus as set rorth in claim 26 wherein said piston has therethrough a passageway, and wherein said arc chamber communicates with said pressure chamber via said passageway.

28. A switchgear apparatus comprising first and second pressure vessels containing dielectric gas, identical first and second mechanisms respectively enclosed within said first and second pressure vessels, each of said first and second mechanisms including a first contact, and a second contact movable into and out of engagement with said first contact, an interrupter operating mechanism operably connected to said first mechanism, and a switch operating mechanism operably connected to said second mechanism.

* * * * *